US006908047B2

(12) United States Patent
Saunders et al.

(10) Patent No.: US 6,908,047 B2
(45) Date of Patent: Jun. 21, 2005

(54) OSCILLATING SHOWER SPRAYER

(75) Inventors: Craig Saunders, Rocky River, OH (US); Jeffrey Kalman, Cleveland Heights, OH (US); Jerry DeGreen, Windsor, OH (US); Lindsey Tufts, Euclid, OH (US); John R. Nottingham, Bratenahl, OH (US); John Spirk, Gates Mills, OH (US)

(73) Assignee: Nottingham Spirk, LLC, Cleveland, OH (US)

( * ) Notice: Subject to any disclaimer, the term of this patent is extended or adjusted under 35 U.S.C. 154(b) by 0 days.

(21) Appl. No.: 10/314,761

(22) Filed: Dec. 9, 2002

(65) Prior Publication Data

US 2003/0132316 A1 Jul. 17, 2003

Related U.S. Application Data

(60) Provisional application No. 60/338,064, filed on Dec. 7, 2001.

(51) Int. Cl.[7] ..... B05B 3/00

(52) U.S. Cl. ..... 239/255.1; 239/381; 239/383

(58) Field of Search ..... 239/463, 225.1, 239/222.15, 222.11, 380, 381, 383, 240, 242, 263, 548, 443

(56) References Cited

U.S. PATENT DOCUMENTS

| | | | | | |
|---|---|---|---|---|---|
| 2,878,066 | A | * | 3/1959 | Weldon | 239/381 |
| 3,563,462 | A | | 2/1971 | Bauer | |
| 3,734,410 | A | * | 5/1973 | Bruno | 239/381 |
| 3,741,481 | A | | 6/1973 | Bauer | 239/589.1 |
| 3,770,200 | A | | 11/1973 | Bauer et al. | |
| 3,791,584 | A | | 2/1974 | Drew et al. | |
| 3,880,357 | A | | 4/1975 | Baisch | 239/380 |
| 3,920,185 | A | | 11/1975 | Kwok | |
| 3,924,808 | A | | 12/1975 | Cooley, Jr. | 239/381 |
| 4,101,075 | A | * | 7/1978 | Heitzman | 239/383 |
| 4,117,979 | A | | 10/1978 | Lagarelli et al. | 239/381 |
| 4,122,845 | A | * | 10/1978 | Stouffer et al. | 239/589.1 |
| 4,177,927 | A | | 12/1979 | Simmons | |
| 4,209,132 | A | * | 6/1980 | Kwan | 239/381 |
| 4,221,333 | A | | 9/1980 | Rodriguez | |
| 4,271,543 | A | | 6/1981 | Martin | |
| 4,340,177 | A | | 7/1982 | Huber | |
| 4,398,668 | A | | 8/1983 | Jette | |
| 4,490,871 | A | | 1/1985 | Martin | |
| 4,542,853 | A | | 9/1985 | Diamond | 239/383 |
| 4,579,284 | A | * | 4/1986 | Arnold | 239/381 |
| 4,640,462 | A | | 2/1987 | Stearns, III | 239/383 |
| 4,801,091 | A | | 1/1989 | Sandvik | 239/381 |
| 4,841,590 | A | | 6/1989 | Terry et al. | |
| 4,944,457 | A | | 7/1990 | Brewer | 239/242 |
| 5,169,072 | A | | 12/1992 | Gulyas | 239/240 |
| 5,205,490 | A | | 4/1993 | Steinhardt et al. | |
| 5,242,113 | A | | 9/1993 | Manderson | 239/263 |
| 5,299,743 | A | | 4/1994 | Sieth et al. | |
| 5,329,651 | A | | 7/1994 | Mardero et al. | |
| 5,450,647 | A | | 9/1995 | Dorsey | |
| 5,704,547 | A | | 1/1998 | Golan et al. | 239/240 |
| 5,857,227 | A | | 1/1999 | Trusty et al. | |
| 5,860,599 | A | * | 1/1999 | Lin | 239/381 |
| 5,950,268 | A | | 9/1999 | Murphy et al. | |
| 6,047,416 | A | | 4/2000 | Carrier | |
| 6,148,453 | A | | 11/2000 | Sartor | |
| 6,186,414 | B1 | * | 2/2001 | Clearman et al. | 239/381 |
| 6,199,771 | B1 | | 3/2001 | Clearman et al. | 239/222.11 |
| 6,230,989 | B1 | * | 5/2001 | Haverstraw et al. | 239/443 |
| 6,254,013 | B1 | | 7/2001 | Clearman et al. | 239/222.11 |
| 6,254,014 | B1 | | 7/2001 | Clearman et al. | 239/222.15 |
| 6,302,339 | B1 | | 10/2001 | Chou | 239/548 |
| 6,648,245 | B1 | * | 11/2003 | Samwell et al. | 239/381 |
| 6,736,336 | B2 | * | 5/2004 | Wong | 239/381 |

* cited by examiner

*Primary Examiner*—Thai-Ba Trieu
(74) *Attorney, Agent, or Firm*—Calfee Halter & Griswold; Diane Dobrea

(57) ABSTRACT

An improved shower sprayer is provided which includes an oscillating head to provide improved water coverage for a shower user. The valve may include a base, at least one oscillating sprayer head supported by the base and a turbine system driven by a current of water fro a water source. The turbine system actuates the oscillating sprayer head.

13 Claims, 6 Drawing Sheets

OSCILLATING SHOWER SPRAYER

PRIORITY CLAIM

This application claims the benefit of U.S. provisional patent application No. 60/338,064 filed on Dec. 7, 2001 the entirety of which is hereby incorporated by reference.

FIELD OF THE INVENTION

This invention relates to plumbing fixtures, especially fixtures for use in distribution of water within a shower.

BACKGROUND OF THE INVENTION

A preferred method of bathing involves the use of a constant shower of water as opposed to a filled tub of water. Showers can be taken quickly and the amount of water used can be more easily regulated. As a result, showers are part of most homes, used either in combination with a traditional bath tub or alone in a stall structure.

One drawback of traditional shower configurations is the small area covered by the stream of water leaving the shower head. The individual showering must manipulate his or her body to place each portion within the narrow coverage area. This can be difficult, especially in a shower configured within a traditional bath tub where room to maneuver is limited.

Some prior attempts to overcome this coverage problem include adjustable shower heads where the stream of water can be widened. This typically involves a corresponding significant decrease in water pressure however. Directionally adjustable shower heads also exist which may be manually moved. These shower heads, however, are often very difficult to adjust or alternatively become loose quickly, thus, not allowing adjustment to a raised position. Removable wand shower heads have also been made, but require the user to give up the use of one hand for washing, etc. in order to manipulate the wand.

An easy to operate shower head configuration is desired which can provide improved water stream coverage.

SUMMARY OF THE INVENTION

The present invention overcomes these and other disadvantages of the prior art by providing an improved shower fixture. A shower sprayer is provided which includes an oscillating sprayer head. Thus, increased coverage of the stream of water is provided without a need for the user to move his or her body extensively. Additionally the shower sprayer does not sacrifice a large amount of water pressure in exchange for the increased coverage area.

In a preferred embodiment of the invention an oscillating shower sprayer is provided which is connectable to a water source. The oscillating shower sprayer includes a stationary base, at least one oscillating sprayer head supported by the base and a turbine system driven by a current of water from a water source and actuating the oscillating sprayer head.

DETAILED DESCRIPTION OF THE PREFERRED AND ALTERNATION EMBODIMENTS

Sprayer General

Figure 1:
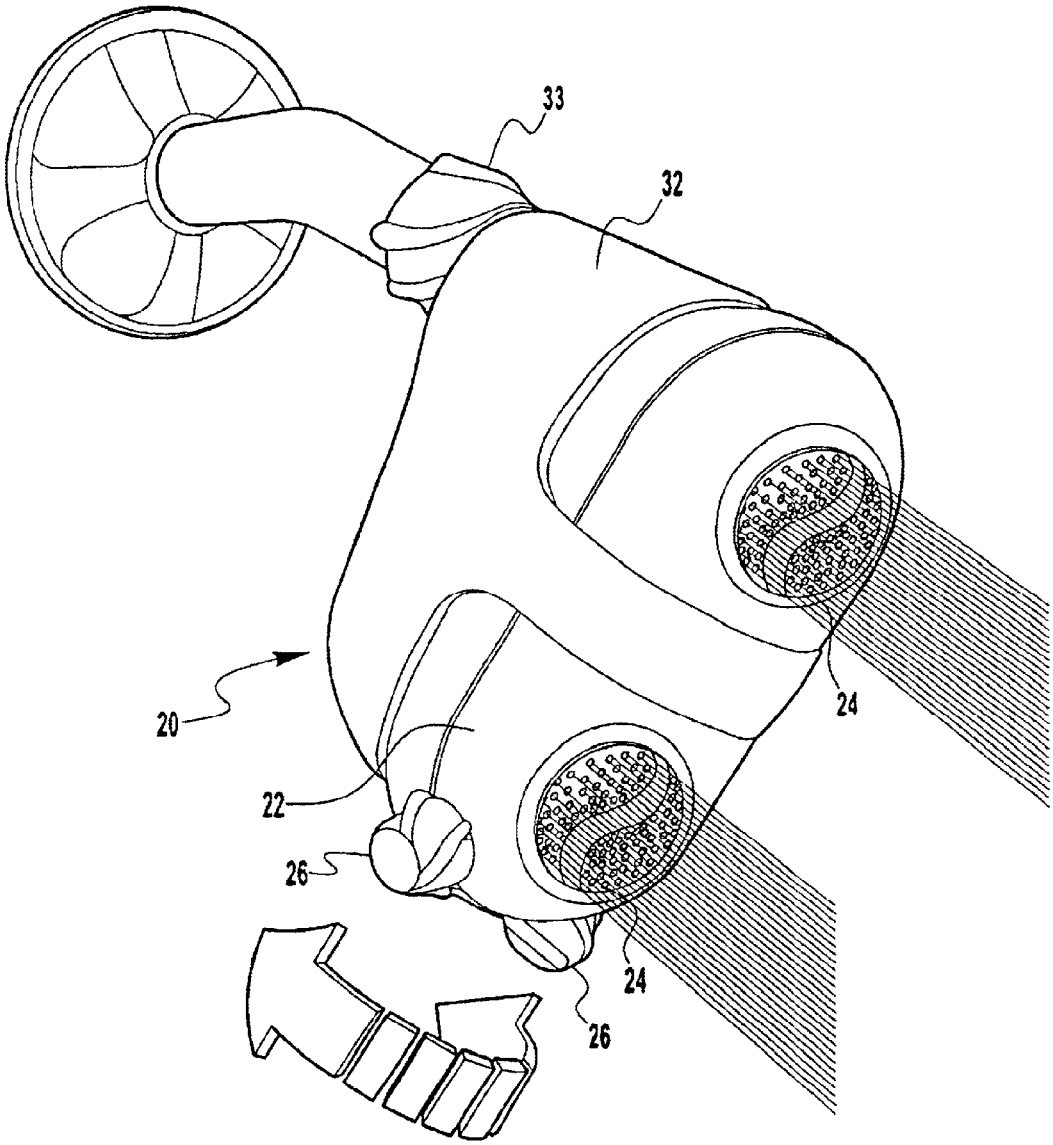
FIG. 1 shows a perspective view of a preferred embodiment of the invention.

As shown in FIG. 1, a shower sprayer 20 is provided which may be installed as original equipment in a home shower or as a retrofit. Additionally the shower sprayer 20 may be used in conjunction with a traditional shower head 82 (see FIG. 3) wherein a valve 80 is installed along with the shower sprayer 20, the valve 80 directing water from a water source to either the shower sprayer 20 or the traditional shower head 82.

Referring to FIG. 1, each embodiment of the invention includes an oscillating sprayer head 22. Oscillation is achieved using a turbine system which converts the force of water flowing under pressure into a mechanical force used to turn the oscillating sprayer head 22. Water then exits the shower sprayer 20 through one or more outlets 24 for use in bathing, etc.

Head

The oscillating sprayer head 22 is supported within a base 32. The sprayer head 22 oscillates in a side to side manner. Different oscillating patterns are described below. The sprayer head 22 includes at least one outlet 24 where the water from the water source exits the shower sprayer 20. The outlets 24 comprise apertures within a solid piece of material. The apertures may be arranged in varying patterns as shown in FIGS. 1 and 3–5. As described below the manner in which water exits the outlets 24 may also be varied.

The sprayer head 22 may also support one or more selectors 26. Alternatively, the selectors 26 may be supported by the base 32. The selectors 26 are used to control aspects of the shower sprayer 20 including: oscillating versus stationary use, oscillating patterns, water distribution manner, and volume of total water discharged from the sprayer head 22.

Base

Figure 2:
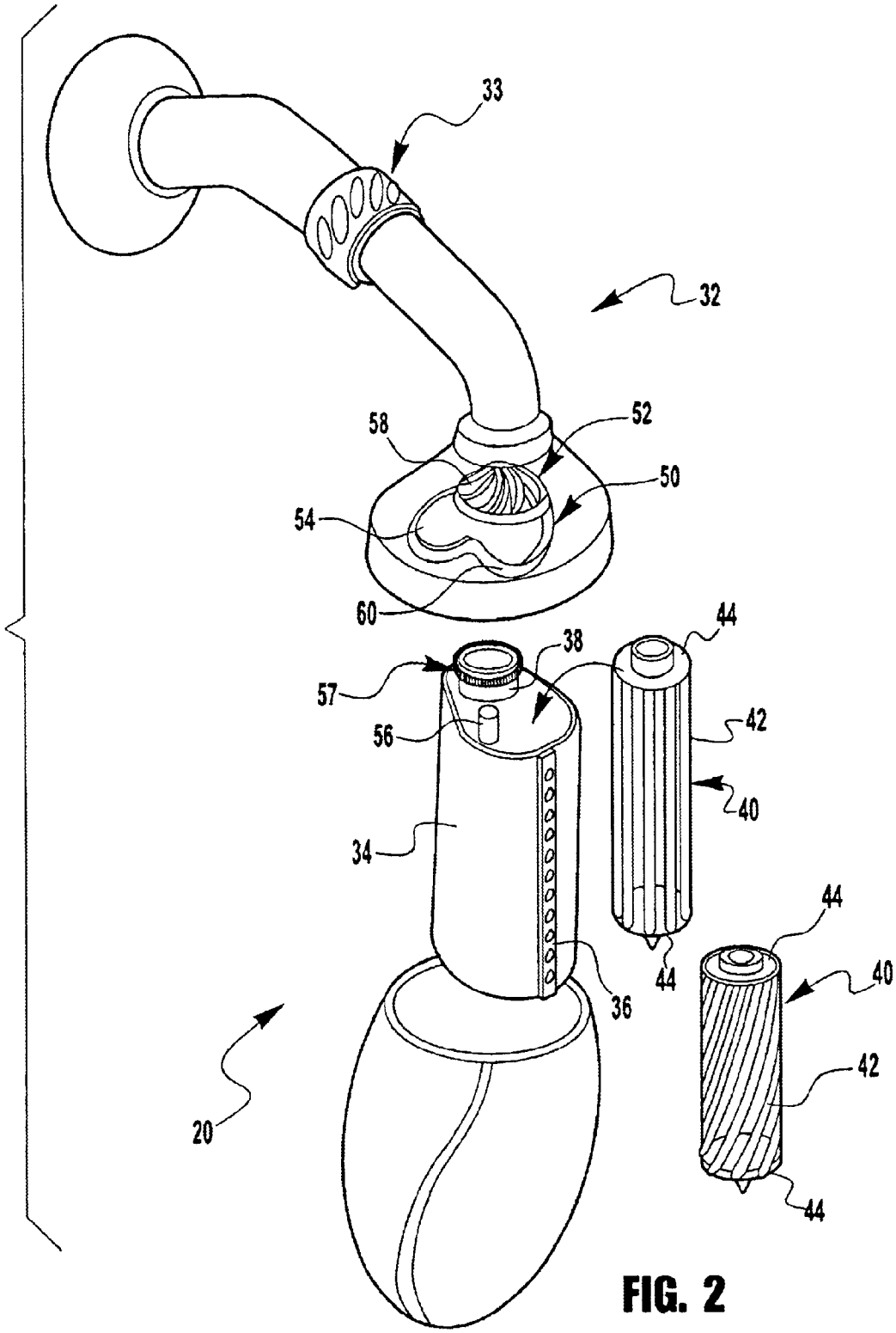
FIG. 2 shows an exploded view of the invention.

The base 32 supports the sprayer head 22 of the shower sprayer 20. The base 32 may be any shape or configuration as described in more detail below. The base 32 includes a water inlet 33. Referring to FIG. 2, the base 32 houses the turbine system 50 also described in more detail below. The base 32 may also house a water chamber 34. The water chamber 34 provides a simple sealed chamber, which may be used when it is difficult to provide a consistent seal around the oscillating head. Thus, the shower sprayer 20 may use a sprayer head 22 and water chamber 34 combination or merely the sprayer head 22 alone. An "O" ring rotating seal 57 provides a junction between the water chamber 34 and the rest of the base 32. The water chamber 34 has a dual purpose. The water chamber 34 provides a place where a volume of water from the water source may be held and distributed in a preferred manner. The water chamber 34 itself includes a chamber inlet 38 and nozzles 36 for outlet of the water. The water chamber 34 may itself be driven by the turbine system 50. The water chamber 34 includes a cam follower 56 which is moved by a cam 54 in the turbine system 50.

The water chamber may also house a rotating spin wheel 40 if the shower sprayer 20 includes a pulsating option in the way the water exits the sprayer head 22. The rotating spin wheel 40 includes a number of vanes 42 located between two flanges 44. The vanes 42 may be straight or at an angle between the two flanges 44. The flanges 44 may include adapting sections in an annular or pointed shape which allow the rotating spin wheel 40 to be held in the water chamber 34 while still having the capacity to spin freely. The rotating spin wheel 40 may be driven by the turbine system 50.

Turbine Drive

FIG. 2 also shows the turbine system 50 which includes a turbine 52, cam 54 and cam follower 56. The cam follower 56 may be affixed to the water chamber 34 or another part of the sprayer head 22. The turbine 52 includes a number of angled turbine vanes 58 which translate the motion of flowing water into a rotational force. The turbine is affixed to a cam 54 having a contoured cam face 60. The contour of the cam face 60 defines the oscillating pattern of the sprayer head 22 described below. Disengagement of the cam 54 from the cam follower 56 is allowed to let the sprayer head 24 be stationary. Engagement and disengagement may be controlled by a selector 26.

Distribution Patterns

Water can be distributed from the sprayer head 22 in a number of different patterns. The distribution patterns may be generated by the shape of the aperture pattern on the outlets 24 and the rotating spin wheel 40 described above. The aperture pattern on the outlets 24 may include but is not limited to the patterns shown in FIGS. 1 and 3–5. To modify the distribution patterns, a selector 26 may be actuated to obstruct any portion of the apertures on one or more outlets 24. A pulsating distribution pattern may be obtained by the operation of the rotating spin wheel 40. The rotating spin wheel 40, intermittently blocks apertures on the outlets 24 to provide an pulsing effect. The distribution patterns may be used in combinations, for example a pulsating stream with one half of the apertures of an outlet 24 blocked.

Motion Patterns

Figure 6B:
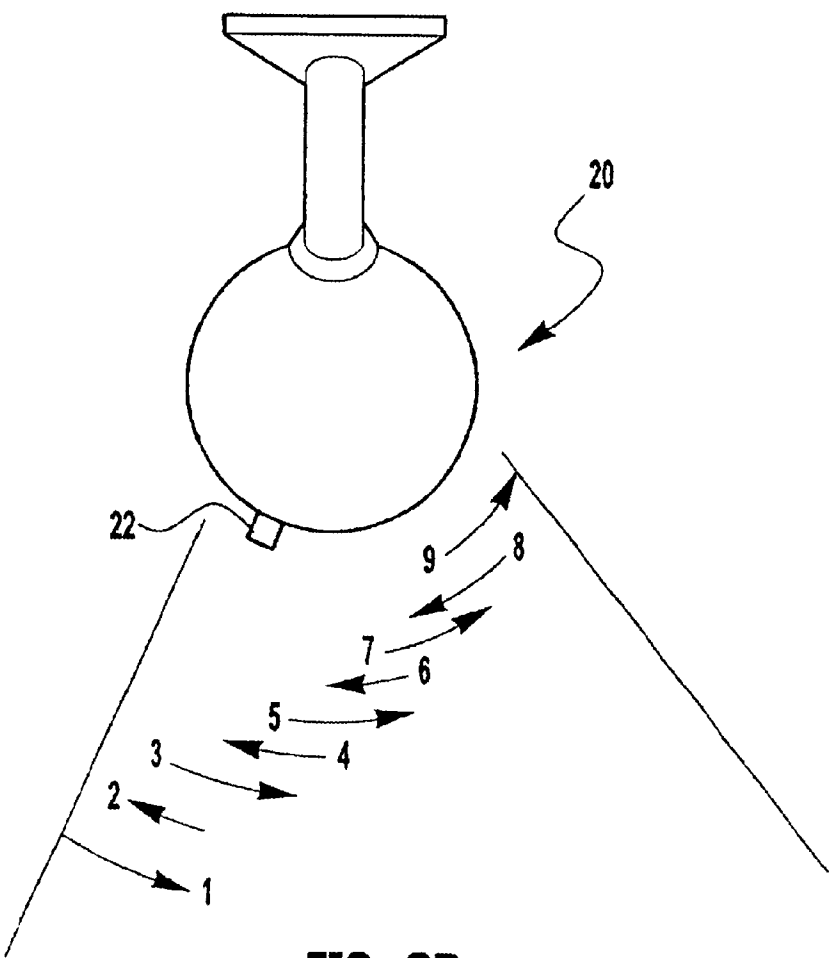
FIG. 6*b* shows a schematic representation of an alternate oscillating pattern of the invention.
Figure 6A:
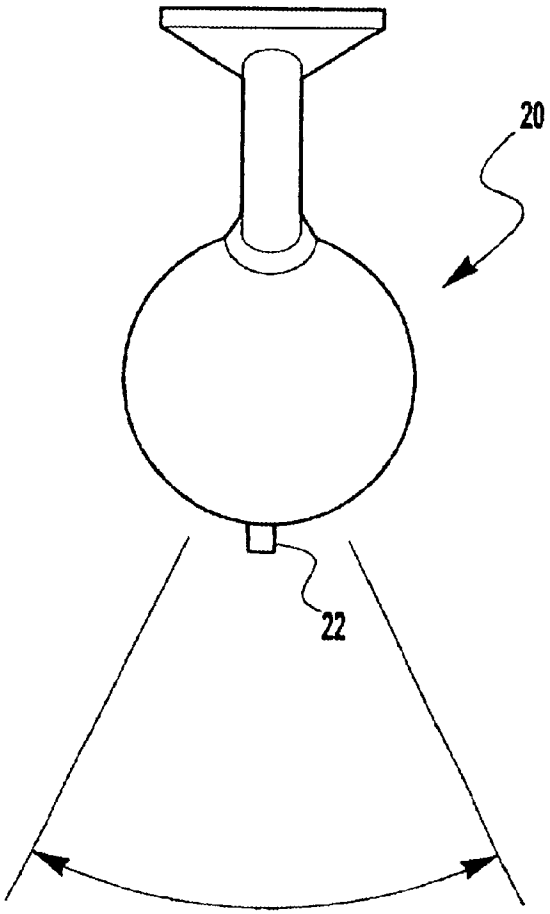
FIG. 6*a* shows a schematic representation of a first oscillating pattern of the invention.

The oscillating motion of the sprayer head 22 may be controlled by the shape of the cam 54 and its cam face 60. FIGS. 6*a* and 6*b* show two typical motion patterns of the sprayer head 22, a full sweep and return sweep motion and a step-by step sweep motion depicted by the numbered steps 1–9. The speed of oscillation may be controlled by the amount of water provided by the water source. The speed of oscillation may also be controlled by changing the resistance of the turbine to moving. Any known manner of reducing speed, such as a friction brake, or means to divert some water away from the turbine may be used. The motion patterns are not limited to only those shown in the Figures.

Size Shape Embodiments

In a first embodiment of the invention shown in FIG. 1, the shower sprayer 20 is a replacement for a common shower head and attaches directly upon the end of the shower water supply pipe. The shower sprayer 20 includes a sprayer head 22 which moves in a side to side manner, pivoting upon a central axis. The shower sprayer 20 includes easily accessible selectors 26 and multiple outlets 24.

Figure 3A:
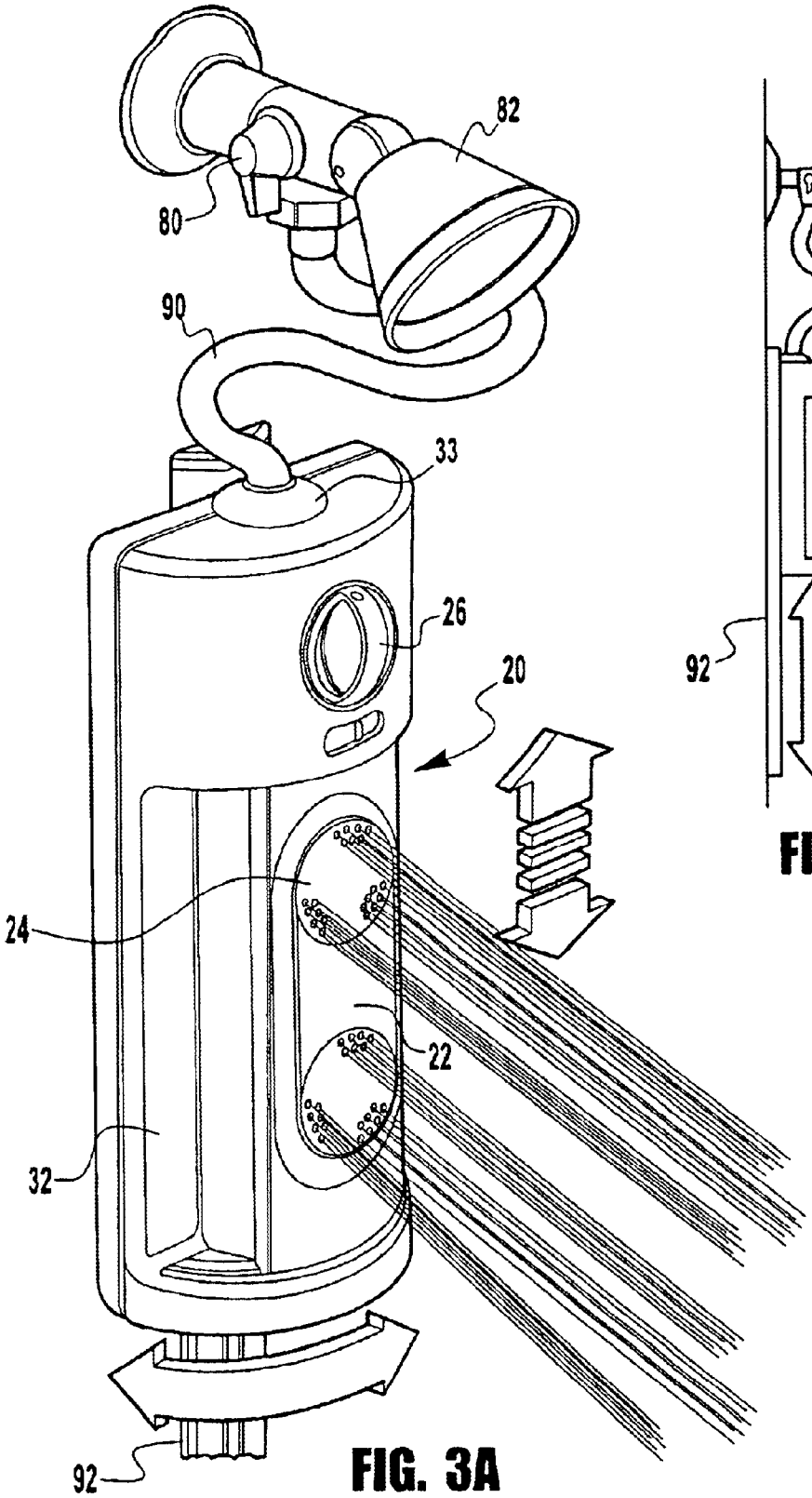
FIG. 3*a* shows a perspective view of a second embodiment of the invention.
Figure 3B:
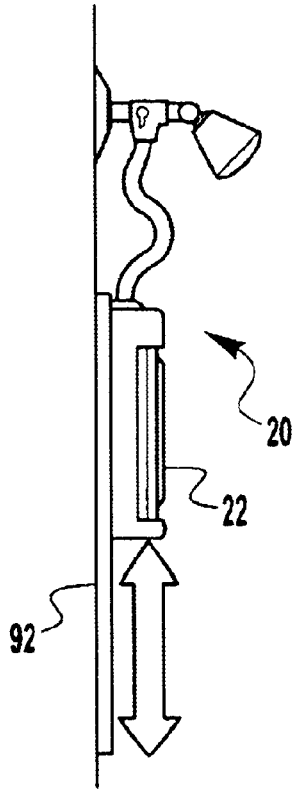
FIG. 3*b* shows a side view of the second embodiment of the invention

In a second embodiment of the invention shown in FIGS. 3 and 3*a*, the shower sprayer 20 is a separate assembly attachable to the wall of a shower chamber as opposed to being supported by the water supply pipe. The assembly is connected to the shower water supply pipe at a valve 80. The valve 80 diverts water to either the shower sprayer 20 or a common shower head 82. A hose 90 or other extendible conduit is used to transfer water to the shower sprayer 20. The shower sprayer 20 may be mounted upon a vertical post or bracket 92. The shower sprayer 20 is movable up or down along the post or bracket 92. This allows water to be directed at any level within a shower chamber.

Figure 4:
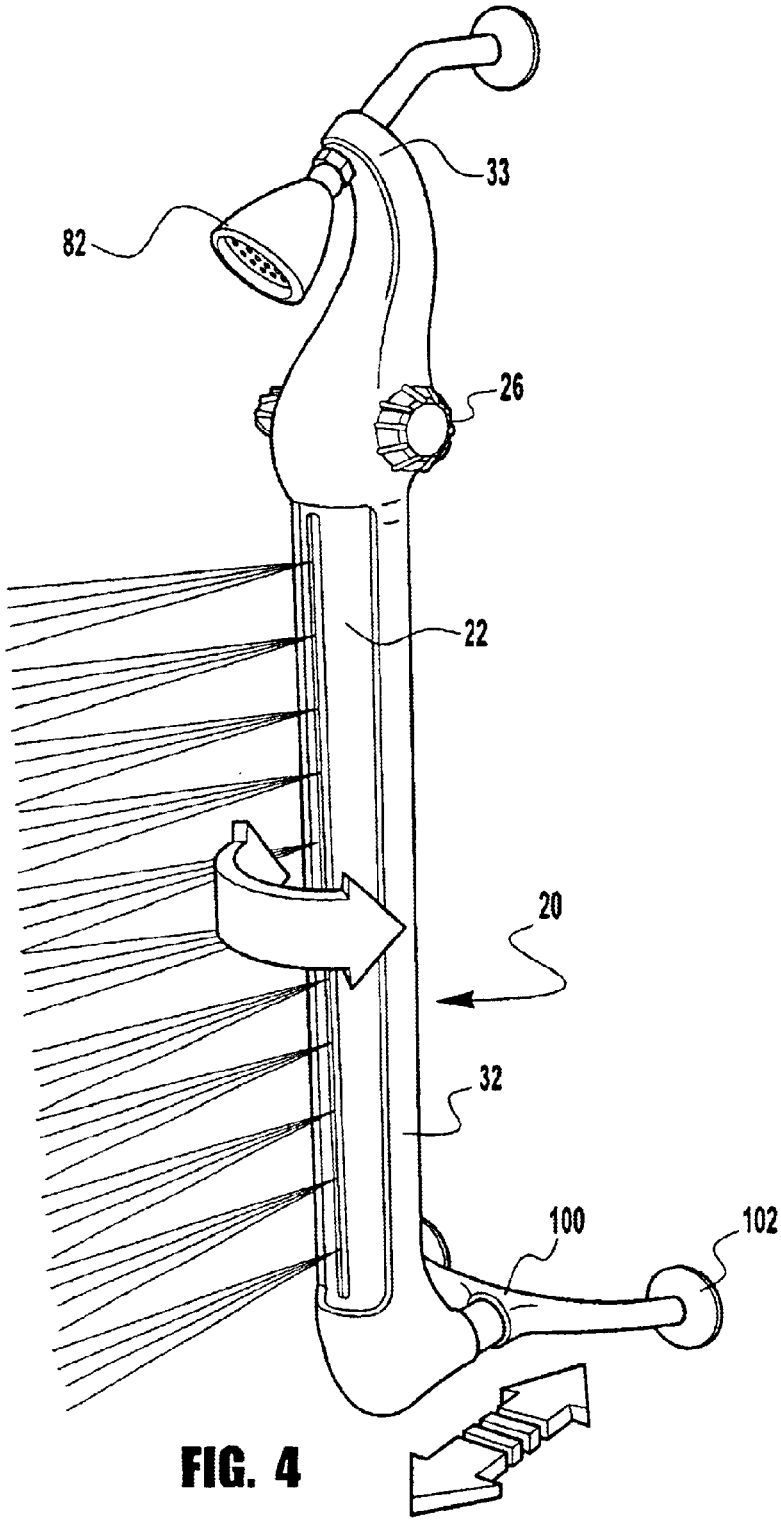
FIG. 4 shows a perspective view of a third embodiment of the invention.
Figure 5:
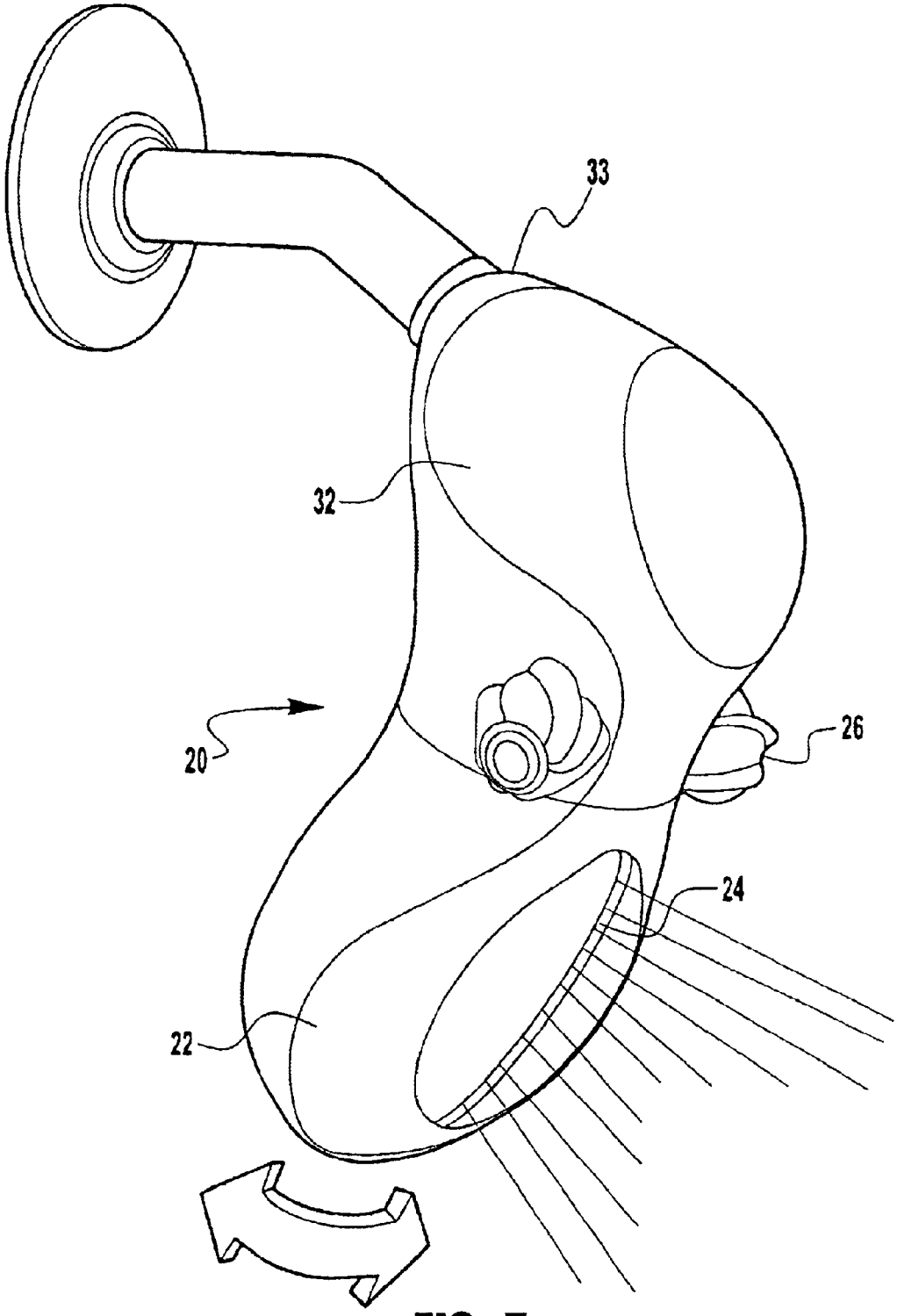
FIG. 5 shows a perspective view of a fourth embodiment of the invention.

In a third embodiment of the invention shown in FIG. 4 the height of the shower sprayer 20 is extended. The shower sprayer 20 is able to cover a large vertical area without adjustment. The shower sprayer 20 is attached to the water supply pipe in a way which still allows the selected use of the traditional shower head. The base 32 of the shower sprayer may be stylistically contoured. The shower sprayer 20 may be installable in a manner which allows removal with no reminder that any shower sprayer 20 was ever present. No drilling of shower tiles or bracket installation is required. The upper end of the shower sprayer 20 is attached to the water supply pipe. The lower end may consist of a forked frame 100 with pads 102 which rest upon the wall of a shower enclosure. The forked frame 100 may be slidably adjustable within the remainder of the base 32 to allow adjustment of the verticality of the shower sprayer 20. The sprayer head 22 is vertically elongated producing a vertical wall of water spray.

In a fourth embodiment of the invention the shower sprayer 20 is a replacement for a common shower head and attaches directly upon the end of the shower water discharge pipe. The sprayer still includes a base 32 and an oscillating sprayer head 22. The base 32 includes easily accessible selectors 26 to control distribution patterns (spray, massage, etc.) and speed of oscillation. The outlet 24 can create a number of spray styles using varied aperture patterns (exterior generates standard shower stream, interior generates pulsing massage style or consistent high volume direct stream). The shape of the shower head may be contoured stylistically.

Additional advantages and modifications will readily appear to those skilled in the art. For example, the aperture patterns in the outlets may be varied. Further, different types of turbines and gears may be used to drive the oscillating sprayer head. Therefore, the invention, in its broader aspects, is not limited to specific details, the representative apparatus, and illustrative examples shown and described. Accordingly, departures may be made from such details without departing from the spirit or scope of the applicant's general inventive concept.

What is claimed is:

1. An oscillating shower sprayer connectable to a water source, said shower sprayer comprising:

a base;

a turbine system comprising a turbine having an axis of rotation that is collinear with an axis of flow from the water source, a cam being operably coupled with the turbine, said cam comprising a contoured cam face; and at least one oscillating sprayer head supported by said base, said sprayer head comprising a cam follower positioned radially relative to the cam, and at a distance away from the axis of flow from the water source wherein the cam follower is engageable with said cam by contact with the contoured cam face, wherein, when said oscillating shower sprayer is in use, said contoured cam face engages with and moves said cam follower to define a sweep pattern of motion of the sprayer head.

2. The oscillating shower sprayer of claim 1, wherein said pattern of motion is either a full sweep and return sweep, or a step by step sweep motion.

3. The oscillating shower sprayer of claim 1, wherein said base comprises an inlet port, and wherein said at least one oscillating sprayer head comprises at least one outlet where water from the water source exits the shower sprayer.

4. The oscillating shower sprayer of claim 3, comprising multiple outlets in the form of apertures within a solid piece of material.

5. The oscillating shower sprayer of claim 4, wherein said apertures are arranged in a pattern.

6. An oscillating shower sprayer connectable to a water source, said shower sprayer comprising:

a base in communication with a water chamber, wherein said water chamber comprises an inlet port connected to the base, said inlet comprising an o-ring rotating seal, and nozzles;

a turbine system comprising a turbine having an axis of rotation that is collinear with an axis of flow from the water source, a cam being operably coupled with the turbine, said cam comprising a cam face; and at least one oscillating sprayer head supported by said base, said sprayer head comprising a cam follower positioned radially relative to the cam, and at a distance away from the axis of flow from the water source wherein the cam follower is engageable with said cam by contact with the cam face.

7. An oscillating shower sprayer connectable to a water source, said shower sprayer comprising:

a base in communication with a water chamber;

a turbine system comprising a turbine having an axis of rotation that is collinear with an axis of flow from the water source, a cam being operably coupled with the turbine, said cam comprising a cam face; and at least one oscillating sprayer head supported by said base, said sprayer head comprising a cam follower positioned radially relative to the cam, and at a distance away from the axis of flow from the water source wherein the cam follower is engageable with said cam by contact with the cam face, wherein said cam follower is located on said water chamber.

8. An oscillating shower sprayer connectable to a water source, said shower sprayer comprising:

a base;

a turbine system comprising a turbine having an axis of rotation that is collinear with an axis of flow from the water source, a cam being operably coupled with the turbine, said cam comprising a cam face;

a rotating spin wheel in operating communication with said turbine system; and at least one oscillating sprayer head supported by said base, said sprayer head comprising a cam follower positioned radially relative to the cam, and at a distance away from the axis of flow from the water source wherein the cam follower is engageable with said cam by contact with the cam face.

9. An oscillating shower sprayer connectable to a water source, said shower sprayer comprising:

a base in communication with a water chamber;

a turbine system comprising a turbine having an axis of rotation that is collinear with an axis of flow from the water source, a cam being operably coupled with the turbine, said cam comprising a cam face;

a rotating spin wheel disposed within the water chamber, said rotating spin wheel in operable communication with said turbine system; and at least one oscillating sprayer head supported by said base, said sprayer head comprising a cam follower positioned radially relative to the cam, and at a distance away from the axis of flow from the water source wherein the cam follower is engageable with said cam by contact with the cam face.

10. An oscillating shower sprayer connectable to a water source, said shower sprayer comprising:

a base;

a turbine system comprising a turbine having an axis of rotation that is collinear with an axis of flow from the water source, a cam being operably coupled with the turbine, said cam comprising a cam face;

at least one oscillating sprayer head supported by said base, said sprayer head comprising a cam follower positioned radially relative to the cam, and at a distance away from the axis or flow from the water source wherein the cam follower is engageable with said cam by contact with the cam face; and selectors for controlling operation of said shower sprayer, comprising a selector for engaging and disengaging said cam and cam follower, wherein said selector controls oscillation of the oscillating shower head.

11. The oscillating shower sprayer of claim 10, comprising a selector for controlling the flow of water through the shower sprayer.

12. The oscillating shower sprayer of claim 10, comprising a selector for controlling the rate of oscillation of the at least one oscillating sprayer lead.

13. An oscillating shower sprayer connectable to a water source, said shower sprayer comprising:

a base;

a turbine system comprising a turbine having an axis of rotation that is collinear with an axis of flow from the water source, a cam being operably coupled with the turbine, said cam comprising a cam face; and at least one oscillating sprayer head supported by said base, said sprayer head comprising a cam follower positioned radially relative to the cam, and at a distance away from the axis of flow from the water source wherein the cam follower is engageable with said cam by contact with the cam face;

wherein, when said oscillating shower sprayer is in use, a current of water from the water source drives rotational motion of the turbine, and said cam, when engaged with said earn follower, moves said cam follower in a side to side manner to actuate motion of said at least one oscillating sprayer head.

* * * * *